US005507132A

United States Patent [19]

Gwiazdon et al.

[11] Patent Number: 5,507,132

[45] Date of Patent: Apr. 16, 1996

[54] APPARATUS FOR OPENING MICROWAVE POPCORN BAGS

[75] Inventors: Rodney K. Gwiazdon, St. Louis Park, Minn.; John E. Korte, Cedar Rapids, Iowa; Richard S. Deadmond, West Bend; Frank C. Starr, New Berlin, both of Wis.

[73] Assignee: General Mills, Inc., Minneapolis, Minn.

[21] Appl. No.: 164,742

[22] Filed: Dec. 10, 1993

[51] Int. Cl.[6] ..... B65B 1/04

[52] U.S. Cl. ..... 53/469; 53/570; 53/386.1; 53/284.7; 53/384.1; 53/459

[58] Field of Search ..... 53/570, 386.1, 53/284.7, 469, 473, 384.1, 459, 571, 572, 371.8, 374.8

[56] References Cited

U.S. PATENT DOCUMENTS

| | | | |
|---|---|---|---|
| 1,071,853 | 9/1913 | Young | 493/444 |
| 1,249,042 | 12/1917 | Dexter et al. | 271/107 |
| 1,886,552 | 11/1932 | Joplin | 53/284.7 |
| 1,909,319 | 5/1933 | Taylor | 53/284.7 |
| 2,364,543 | 12/1944 | Moore | 53/482 |
| 2,925,695 | 2/1960 | Fry | 53/482 |
| 2,952,959 | 9/1960 | Piazze | 53/284.7 |
| 3,462,070 | 8/1969 | Corella . | |
| 3,493,226 | 2/1967 | Weir | 493/449 |
| 3,503,179 | 3/1970 | Pierre | 53/386.1 |
| 3,570,751 | 3/1971 | Trewella . | |
| 3,608,709 | 9/1971 | Pike . | |
| 3,615,711 | 10/1971 | Markus et al. . | |
| 3,632,104 | 1/1972 | Dufour | 493/444 |
| 3,720,559 | 3/1973 | Odom et al. | 53/482 |
| 3,745,892 | 7/1973 | Ganz | 493/125 |
| 3,788,035 | 1/1974 | Geisel | 53/282 |
| 3,854,385 | 12/1974 | Wallin | 493/124 |
| 3,955,334 | 5/1976 | Wild et al. | 53/571 |
| 4,019,305 | 4/1977 | McGhie et al. | 53/482 |
| 4,033,093 | 7/1977 | Mencacci | 53/571 |
| 4,061,327 | 12/1977 | Blessing | 493/457 |
| 4,084,391 | 4/1978 | Williams, Sr. et al. | 493/457 |
| 4,108,300 | 8/1978 | Hayase et al. | 53/386.1 |
| 4,201,118 | 5/1980 | Calvert | 493/125 |
| 4,257,209 | 3/1981 | Tetenborg et al. | 53/375.7 |

(List continued on next page.)

FOREIGN PATENT DOCUMENTS

| | | | |
|---|---|---|---|
| 569335A | 5/1993 | European Pat. Off. . | |
| 565303 | 11/1932 | Germany . | |
| 635952 | 9/1936 | Germany . | |
| 2714584 | 11/1978 | Germany . | |
| 8213834 | 5/1981 | Germany | 53/567 |
| 0002123 | 5/1976 | Japan | 493/457 |
| 9315976 | 8/1993 | WIPO . | |

*Primary Examiner*—John Sipos
*Assistant Examiner*—Gene L. Kim
*Attorney, Agent, or Firm*—L. MeRoy Lillehaugen; John A. O'Toole; Alan D. Kamrath

[57] ABSTRACT

A device for opening bags (12) held in fixtures (32) movable in an operation direction is disclosed including first and second suction cups (104, 106). The first suction cups (104) are mounted to an elongated bar (108) slideably mounted on posts (112) in turn upstanding from pivot arms (110). The elongated bar (108) can be slid on the posts (112) to an upper, transport position allowing passage of the fixtures (32) and bags (12) held therein. The second suction cups (106) are mounted to the lower ends of rods (114) mounted to a slide shaft (116), with sliding of the slide shaft (116) moving the rods (114) and suction cups (106) from a transport position intermediate the lanes of the fixtures (32) as they move in the operation direction and an attachment position in front of the bags (12). The slide shaft (116) and the rods (114) are tilted along an arc to open the unsealed ends (22) of the bags (12). During opening, the bottoms (16) of the bags (12) deform around first and second, stationary pins (280) which then sandwich the top gussets of the sides (18) of the bags (12) against the tops (14) of the bags (12). After release of the suction cups (104, 106), the tops (14) of the bags (12) deform around the stationary pins (280) when the fixtures (32) move in the operation direction.

32 Claims, 3 Drawing Sheets

U.S. PATENT DOCUMENTS

| | | | |
|---|---|---|---|
| 4,257,210 | 3/1981 | Tetenborg et al. | 53/375.7 |
| 4,320,615 | 3/1982 | Gmur | 53/386.1 |
| 4,337,862 | 7/1982 | Suter . | |
| 4,348,853 | 9/1982 | Morse et al. | 53/571 |
| 4,450,180 | 5/1984 | Watkins . | |
| 4,548,826 | 10/1985 | Watkins | 53/469 |
| 4,604,854 | 8/1986 | Andreas | 53/552 |
| 4,621,480 | 11/1986 | Aiuola et al. | 53/234 |
| 4,669,249 | 6/1987 | Aiuola et al. | 53/234 |
| 4,691,374 | 9/1987 | Watkins et al. . | |
| 4,735,513 | 4/1988 | Watkins et al. . | |
| 4,845,924 | 7/1989 | Focke et al. | 53/234 |
| 4,861,325 | 8/1989 | DiMarzio | 493/124 |
| 4,873,815 | 10/1989 | Tetenborg et al. | 53/571 |
| 4,878,765 | 11/1989 | Watkins et al. . | |
| 4,890,439 | 1/1990 | Smart et al. . | |
| 5,044,777 | 9/1991 | Watkins et al. . | |
| 5,171,950 | 12/1992 | Brauner et al. . | |
| 5,180,357 | 1/1993 | Marzullo | 493/420 |
| 5,269,117 | 12/1993 | Boriani et al. | 53/234 |

10
12
14
16
18
22
24
30
32
34
36
37
38
40
42
44
46
48
49
60
104
105
106
108
110
112
114
118
120
280
2
2

10
5
5
12
14
16
18
22
24
32
60
104
106
108
110
112
114
116
118
120
122
126
128
132
274
276
278
280

APPARATUS FOR OPENING MICROWAVE POPCORN BAGS

BACKGROUND

The present invention generally relates to apparatus for opening bags, particularly to apparatus for opening bags for food products, more particularly to apparatus for opening bags having gusseted sides, and specifically to apparatus for opening microwave popcorn bags.

Popcorn is a highly popular snack food item. In the past, the at-home preparation of popcorn by the consumer involved adding kernel popcorn plus a cooking oil to a covered pot and heating until the popcorn kernels popped to make popcorn. As used herein, "kernel popcorn" refers to unpopped popcorn. The noun "popcorn" or synonymously "popped popcorn" refers herein to popped kernel popcorn. The adjective "popcorn" can refer to either.

More recently, microwave popcorn products have become extremely popular. At present, in the United States of America, over 70 different brands of microwave popcorn products are available. In general, the more popular microwave popcorn products comprise an expandable paper bag containing a charge of kernel popcorn, fat and salt. The microwave popcorn article is adapted to be heated in a microwave oven for three to five minutes to produce the popped popcorn. More recently, improved microwave popcorn articles have been fabricated employing a metallized susceptor which facilitates the heating of the popcorn-fat charge and which, in turn, leads desirably to increases in popcorn volume and decreases in unpopped kernels. Microwave popcorn articles of this type are described in detail in, for example, U.S. Pat. No. 4,450,180 (issued May 22, 1984 to J. D. Watkins and incorporated herein by reference).

The prior art is replete with various apparatus and methods for filling and sealing microwave popcorn bags and in some cases folding the bag generally into a central portion having first and second wing portions extending from opposite ends thereof from folds. For example, U.S. Pat. Nos. 4,450,180; 4,548,826; 4,604,854; and 5,171,950 show techniques for filling and sealing microwave popcorn bags. Particularly, the charge of popcorn, fat and salt could be dropped as a prefabricated toroid- or doughnut-shaped piece into an open end of the bag prior to its sealing. More recently, the popcorn, fat in the form of a slurry, and salt are filled in the open end of the bag prior to its sealing. However, changes in the marketing of microwave popcorn have created demand for improved techniques for opening microwave popcorn bags. Specifically, with the increasing competitiveness of the microwave popcorn business, a need exists for apparatus and methods which achieve higher output speeds in "bags per minute" while reducing the amount of labor, downtime, and floor space required. Additionally, with the reduction in the amount of material and/or layers utilized in the formation of paper popcorn packages including a microwave susceptor such as shown and described in International Publication No. WO 93/15976 published on Aug. 19, 1993, a need exists for apparatus and methods which are capable of running bags of flimsy construction as well as reducing product and material damage. Additionally, with the introduction of various types and sizes of bags to meet particular market types and conditions and for enhancing product performance, a need exists for apparatus and methods which are capable of handling different sizes of bags such as single or multiple serving sizes, and/or different types such as gusseted or non-gusseted bags, and/or different configurations of bags.

SUMMARY

The present invention solves these needs and other problems in the field of opening microwave popcorn bags or the like by providing, in the most preferred form, members for removable securement to the top and bottom of a bag and movable between a transport position allowing the bag to move past them and an attachment position, with the member for removable securement to the bottom also being movable to an open position while the top is secured by the other member to open an end of the bag.

In a preferred aspect of the present invention, the bottom of a bag is removably secured to a member attached to a rod extending in a direction generally parallel to the bottom of the bag, with the rod spaced from the bottom in a direction perpendicular to the operation direction and outwardly of the side edge of the bag in a transport position and located inwardly of the side edge of the bag and in the operation direction in front of the bottom of the bag in an attachment position. In a preferred form of the present invention, the rod is tilted from the attachment position to an open position by moving the rod along an arc.

In another aspect of the present invention, the top of a bag is removably secured to a member attached to an elongated bar extending in a direction perpendicular to the operation direction and parallel to the top and movable in a direction perpendicular to the operation direction and the elongated bar between a transport position allowing the bags to pass in the operation direction and an attachment position.

In a further aspect of the present invention, first and second pins are provided to engage the top gussets and sandwich them against the top of the bag, with the bottom of the bag deforming around the pins as it is moved to an open position relative to the top.

It is thus an object of the present invention to provide a novel apparatus for opening bags.

It is further an object of the present invention to provide such a novel bag-opening apparatus achieving higher output speeds in "bags per minute" than current technology.

It is further an object of the present invention to provide such a novel bag-opening apparatus providing positive control of the bags during opening.

It is further an object of the present invention to provide such a novel bag-opening apparatus capable of running various types and sizes of bags including gusseted and non-gusseted bags, multi- or single-ply paper bags, or bags of flimsy-type structure.

It is further an object of the present invention to provide such a novel bag-opening apparatus which is very compact, minimizing floor surface and work space required.

It is further an object of the present invention to provide such a novel bag-opening apparatus which is easily accessible from the floor for trouble shooting, maintenance, and the like.

It is further an object of the present invention to provide such a novel bag-opening apparatus allowing easy changeover for different sized bags and for reducing down time.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figures 1, 2:
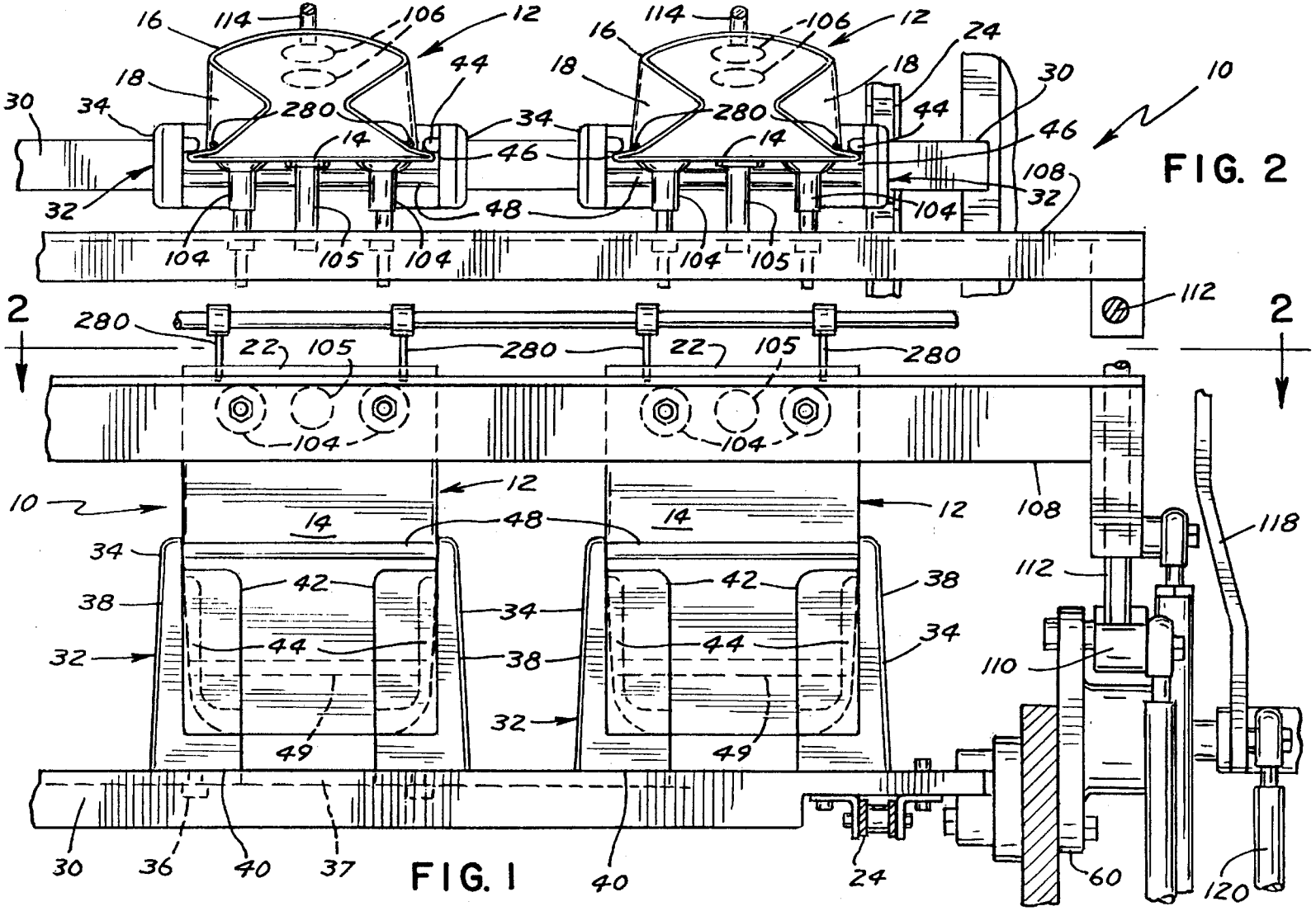
FIG. 1 shows a partial, cross sectional view of a microwave popcorn bag opening device according to the preferred teachings of the present invention.
FIG. 2 shows a partial, cross sectional view of the microwave popcorn bag opening device of FIG. 1 according to section line 2—2 of FIG. 1.
Figures 3, 4:
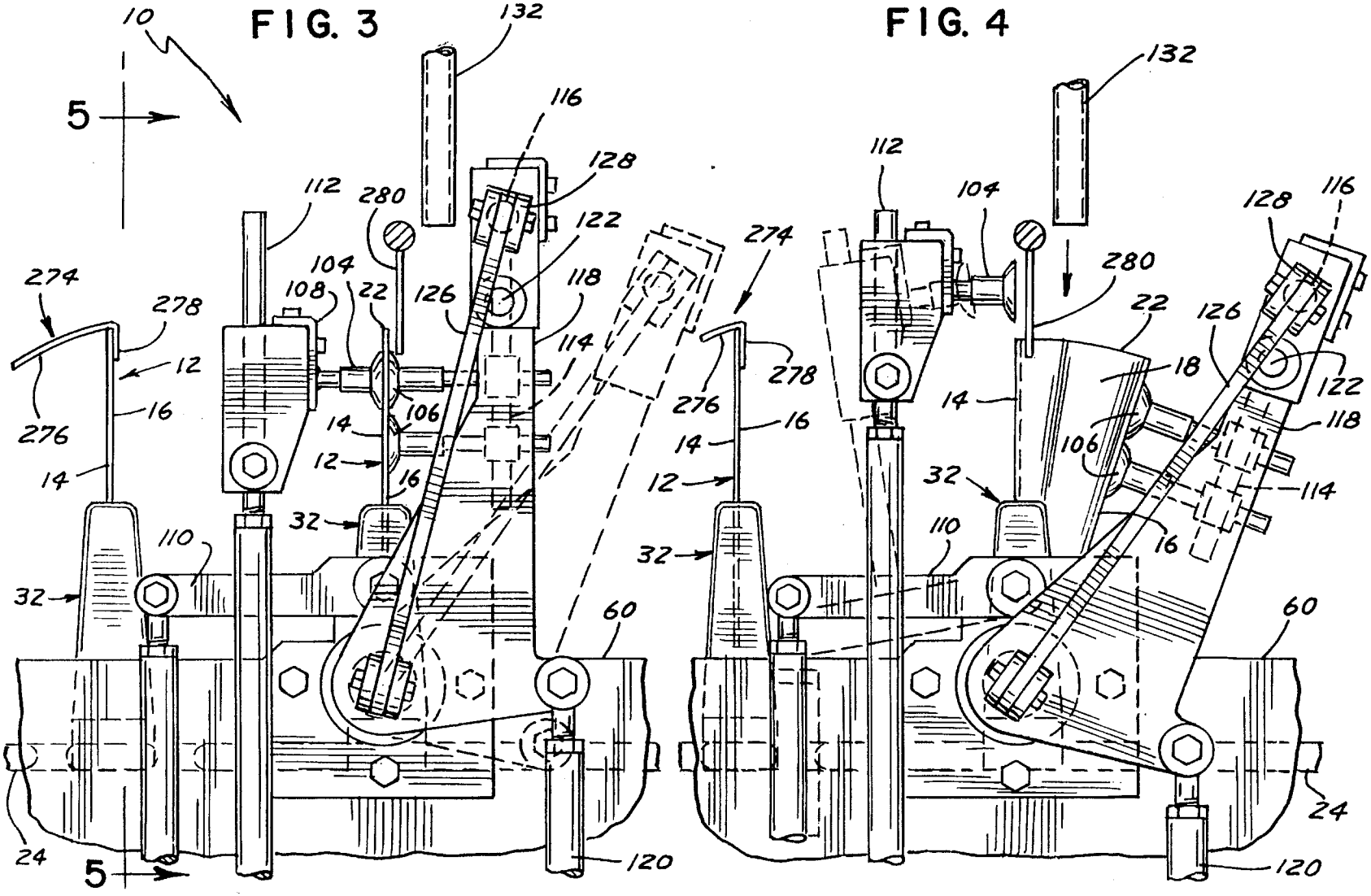
FIG. 3 shows a partial, cross sectional view of the microwave popcorn bag opening device of FIG. 1 in an attachment position.
FIG. 4 shows a partial, cross sectional view of the microwave popcorn bag opening device of FIG. 1 in an open position.
Figure 5:
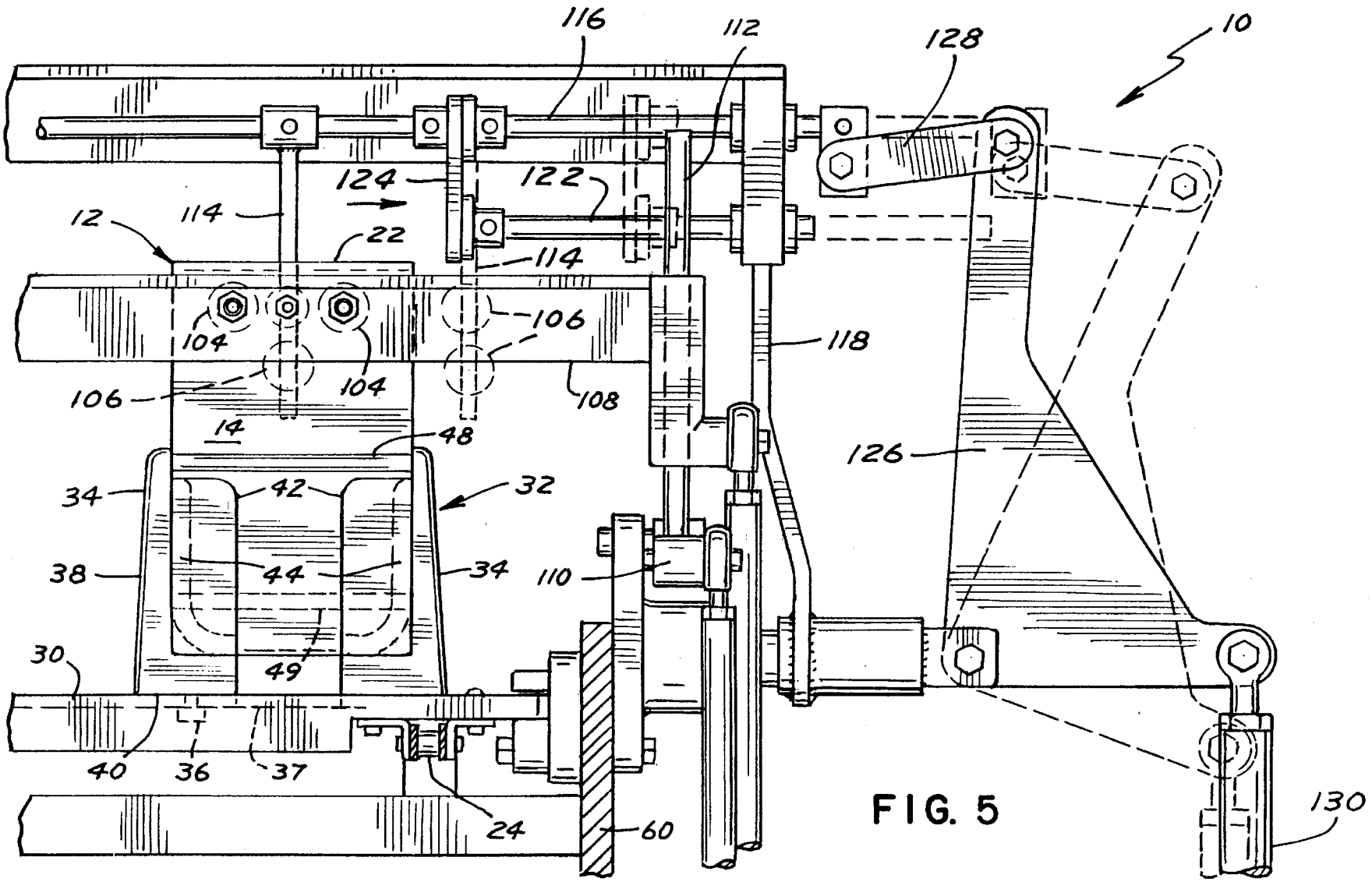
FIG. 5 shows a partial, cross sectional view of the microwave popcorn bag opening device of FIG. 1 according to section line 5—5 of FIG. 3.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "front", "back", "rear", "upper", "lower", "height", "width", "end", "side", "horizontal", "vertical", and similar terms are used herein, it should be understood that these terms have reference only to the structure shown in the drawings as it would appear to a person viewing the drawings and are utilized only to facilitate describing the invention.

DESCRIPTION

An apparatus for opening bags 12 according to the preferred teachings of the present invention is shown in the drawings and generally designated 10. In the most preferred form, bags 12 are of the current type for the marketing of microwave popcorn and each include a top 14, a bottom 16 including the microwave susceptor, first and second gusseted sides 18, a first, lower, sealed end, and a second, upper, unsealed end 22. In the most preferred form, bottom 16 has a width less than top 14. Each side 18 includes a top gusset pivotally connected to top 14 about a fold line and includes a bottom gusset pivotally connected to bottom 16 about a fold line and also pivotally connected to the corresponding top gusset. It should be noted that bags 12 can be of other types and varieties than bags 12 as shown, such as but not limited to bags 12 where top 14 and bottom 16 are of equal or different widths, nongusseted bags 12, or the like. Also, bags 12 can be formed of various types of materials including paper of either multi-ply or single-ply variety, plastic, and like materials including flimsy-type materials.

Apparatus 10 generally includes at least first and second roller chains 24 arranged as closed loops extending around sprockets. Multiple carrier bars 30 are provided including first portions secured to roller chains 24 at equal circumferential spacing along the closed loops. Each carrier bar 30 includes a second portion having a plurality of bag-holding fixtures 32 secured thereto corresponding to the number of lanes of bags 12 which are being filled and sealed in apparatus 10, with 4 lanes being provided in apparatus 10 and 4 fixtures 32 being provided on each carrier bar 30 in the preferred form. The first and second portions of bars 30 are removably secured together such as by bolts. It can then be appreciated that changeover for different sized bags can be easily accomplished and/or down time is reduced in the event of fixture contamination, breakage, or the like by simply replacing the second portions of bars 30 with fixtures 32 secured thereon. Any cleaning or repair can be accomplished while the second portions of bars 30 and fixtures 32 secured thereon are removed from apparatus 10 and as apparatus 10 continues to operate with other, replacement, second portions of bars 30 and fixtures 32 secured thereon being secured to the first portions of bars 30 secured to roller chains 24.

In the most preferred form, fixtures 32 each include first and second fixture halves 34 secured in a spaced relation to the second portions of bars 30 by suitable means such as bolts 36. An aperture 37 is formed in bars 30 intermediate halves 34 of each fixture 32. Each half 34 includes a side plate 38 and a bottom plate 40 extending generally perpendicular to the bottom ends of plate 38. Each half 34 further includes a support plate 42 of a generally rectangular configuration and extending generally perpendicular to side plates 38 and bottom plate 40. Each half 34 further includes an abutment 44 of a generally L-shaped configuration having a first leg secured and extending generally perpendicular to plate 38 and a second leg secured to and extending generally perpendicular to plate 40. In the most preferred form, the first and second legs of abutment 44 include an arcuate portion at their interconnection. Abutment 44 has arcuate inside edges and provides a camming surface opposite to support plate 42. Support plate 42 and abutment 44 are generally parallel and spaced from each other and form a slot 46 therebetween for receiving the side edges of bag 12. Side plates 38 further include bores for slideably receiving the ends of a folding bar 48, with bar 48 being captured in the bores of side plates 38 of the first and second fixtures halves 34 forming each fixture 32. The forward extent of bar 48 is generally equal to the forward extent of support plates 42 of halves 34 of fixtures 32. The first legs of abutment 44 include bores for slideably receiving the ends of an expansion prevention bar 49, with bar 49 being captured in the bores of abutment 44 of the first and second fixture halves 34 forming each fixture 32.

It can then be appreciated that as roller chains 24 move around the sprocket sets, bars 30 and fixtures 32 carried thereby are positioned along the closed loop arrangement of roller chains 24, with chains 24 being movable in an operation direction intermittently by any suitable means in the most preferred form.

Stationary guides 274 are attached to frame 60 to prevent bags 12 from moving from slots 46 of fixtures 32 under centrifugal forces as fixtures 32 move from the vertical portion to the horizontal portion of the closed loops of roller chains 24. Guides 274 include a first arcuate portion 276 which abuts with open ends 22 of bags 12 as they move around portions of the closed loops wherein change of direction from generally vertical to generally horizontal occurs. Guides 274 terminate in vertical stops 278 which abut with bottoms 16 adjacent ends 22 when fixtures 32 stop at the first intermittent position in the horizontal portion of the closed loops of roller chains 24.

As bars 30 intermittently advance in the operation direction along the horizontal portion of the closed loops of roller chains 24, bags 12 can be filled with a variety of material such as popcorn kernels and grease in the most preferred form. Where it is necessary to hold open ends 22 of bags 12 to allow filling, apparatus 10 includes first suction cups 104 associated with each bag 12 for removable securement to top 14 above fixtures 32 and second suction cups 106 for removable securement to bottom 16.

In the most preferred form, suction cups 104 are mounted to an elongated bar in the form of an angle iron 108 extending behind fixtures 32 and in a direction perpendicular to the operation direction of fixtures 32 and parallel to tops 14 of bags 12 held therein. First and second pivot arms 110 are pivotally mounted to frame 60 on opposite sides of apparatus 10 about an axis perpendicular to the operation direction of fixtures 32. Posts 112 upstand from pivot arms 110, with the ends of angle iron 108 slideably mounted to posts 112. Thus, angle iron 108 can be slid on posts 112 in a direction perpendicular to the operation direction and to angle iron 108 between an upper, transport position located above and spaced from fixtures 32 and bags 12 allowing fixtures 32 and bags 12 to pass underneath during movement of carrier bars 30 along the horizontal position of the closed loops of roller chains 24 and a lower, attachment position located above fixtures 32 with suction cups 104 positioned below ends 22 of bags 12 and adjacent to tops 14. By pivoting arms 110 when carrier bars 30 have stopped in their intermittent positions and with angle iron 108 in its lower position, angle iron 108 and suction cups 104 mounted thereon can be moved towards fixtures 32 and bags 12 until suction cups 104 engage and become attached to tops 14 of bags 12 for holding tops 14 in a generally linear position from slots 46 of fixtures 32. In the most preferred form, two suction cups 104 are provided to engage top 14 of each bag 12 at generally horizontally offset positions. Additionally, an abutment 105 is carried by angle iron 108 intermittent the two suction cups 104 for abutting with top 14 of bag 12 horizontally intermediate suction cups 104.

In the most preferred form, suction cups 106 are mounted to the lower ends of vertically extending rods 114 extending in a direction generally parallel to bottoms 16 of bags 12 held in fixtures 32. The upper ends of rods 114 are mounted to a slide shaft 116. Slide shaft 116 is horizontally slideably movable in a direction perpendicular to the operation direction of fixtures 32 between an attachment position and a transport position. In the transport position, rods 114 and suction cups 106 are positioned intermediate the lanes of fixtures 32 as carrier bars 30 move along the horizontal portion of the closed loops of roller chains 24 and specifically are spaced from bottoms 16 in a direction perpendicular to the operation direction of fixtures 32 and outwardly of the side edges of bags 12. In the attachment position, rods 114 and suction cups 106 are positioned inwardly of the side edges of bags 12 and in the operation direction in front of bottoms 16 of bags 12 and fixtures 32. Shaft 116 is moved in an arc from the attachment position with suction cups 106 positioned coextensive with slots 46 of fixtures 32 and an open position with suction cups 106 spaced from the front of fixtures 32.

In the most preferred form, shaft 116 is moved in an arc in a plane extending parallel to the operation direction of fixtures 32 by a triangular-shaped crank arm 118 pivotably mounted by one corner to frame 60 about an axis. Shaft 116 is pivotally mounted to the upper corner of crank arm 118. Crank arm 118 is pivoted about the axis by an actuator 120 attached to the other corner of crank arm 118. Shaft 116 is prevented from rotating by a reference shaft 122 slideably mounted in crank arm 118 parallel to shaft 116. A connector arm 124 extends between and is secured to each of shafts 116 and 122 in a nonrotatable manner. Shaft 116 is slid in crank arm 118 by a crank arm 126 pivotally mounted by one corner about an axis extending generally perpendicular to the pivot axis of crank arm 118. A connector link 128 is pivotally connected between shaft 116 and an upper corner of crank arm 126. Crank arm 128 is pivoted by an actuator 130 attached to the other corner of crank arm 126.

In the most preferred form, two suction cups 106 are provided to engage bottom 16 at generally vertically offset positions. In the most preferred form, the upper suction cups 106 engage bags 12 above fixtures 32 generally in line with stop 105, with stop 105 providing abutment for the upper suction cups 106 for insuring securement to bottom 16. The lower suction cups 106 engage bags 12 generally at the upper extent of fixtures 32, with folding bar 48 providing abutment for the lower suction cups 106 for insuring securement to bottom 16.

In operation of apparatus 10 of the most preferred form, angle iron 108 is located in its upper position and rods 114 are located in their transport positions allowing movement of carrier bars 30 and bag holding fixtures 32 thereby. After carrier bars 30 and bag holding fixtures 32 have moved to the intermittent position, angle iron 108 is lowered to its lower position and pivot arms 110 are pivoted to attach suction cups 104 to tops 14. Simultaneously, rods 114 are moved horizontally and shaft 116 is pivoted to its attachment position to engage suction cups 106 to bottoms 16. After the application of a vacuum, suction cups 104 and 106 engage and hold bags 12 located in fixtures 32. Shaft 116 is then pivoted from its attachment position to its open position to rotate rods 114 to pull bottoms 16 of bags 12 outwardly. As top 14 of each bag 12 is held by suction cups 104, bottom 16 is separated from top 14, opening gusseted sides 18 and end 22.

To bias the separation of bottom 16 from the bottom gusset of sides 18 rather than top 14 from the top gusset of sides 18, first and second stationary fingers or pins 280 are provided to abut with the top gusset of sides 18 attached to top 14. In the most preferred form shown, pins 280 are vertically oriented, have circular cross sections, and have free ends which are positioned vertically above fixtures 32. Pins 280 are parallel and spaced slightly less than the width of bottom 16 generally parallel to and within the fold lines between the top gussets of sides 18 and top 14 and the fold lines between the bottom gussets of sides 18 and bottom 16, and are positioned to abut with bottom 16 below end 20 when bags 12 are completely collapsed and initially positioned in the intermittent position including the bag opening device. As bottom 16 is pulled when shaft 116 is rotated, bottom 16 deforms with the edges of bottom 16 deflecting around and passing pins 280, with the ease of passage of bottom 16 beyond pins 280 being enhanced when bottom 16 has a width less than top 14 in the most preferred form. When bottom 16 passes pins 280, pins 280 then abut with the top gusset of sides 18 and hold or sandwich the top gusset of sides 18 against top 14. Top 14 does not pass pins 280 due to the connection of suction cups 104 and in the most preferred form due to its greater width than bottom 16. Abutment of the top gusset of sides 18 towards top 14 by pins 280 tends to unfold the bottom gussets of sides 18 from bottom 16 to increase the open area between the bottom gussets of sides 18 and bottom 16 for receipt of the product. Although pins 280 are shown in the most preferred form, other methods for biasing the separation of bottom 16 from the bottom gusset of sides 18 could be utilized in conjunction with or instead of pins 280 such as but not limited to air blast jets or nozzles, stops which tend to arcuately shape bottom 16 when attached to suction cups 106, or the like.

It should then be noted that the particular construction of fixtures 32 are advantageous in opening bags 12 in apparatus 10 according to the preferred teachings of the present invention. Particularly, abutments 44 generally hold bottom 16 by its side edges such that bottom 16 tends to naturally bulge outwardly and separate from top 14 and gusseted sides 18 in fixtures 32 without wrinkling. Additionally, the arcuate inside edges as well the arcuate portion at the interconnection of the legs of abutment 44 help define a pocket spaced from the edges and corners of bags 12 for receipt and capture of product, with such a pocket being advantageous in holding and containing the product in the final form. Material can then be fed into bags 12 through ends 22 held open by suction cups 104 and 106 into this bulge of bottom 16. This is especially advantageous for microwave popcorn popping bags 12 as it is desired to load the popcorn and oil adjacent to the susceptor pad located on bottom 16. Further, expansion prevention bars 49 limit the size of the pocket to prevent bags 12 from blossoming out between abutments 44 due to the introduction of the product and help to retain bags 12 from slipping out of fixtures 32 in the operation direction and between abutments 44 especially when moving with chains 24 and when filled with product. Carrier bars 30 can be vibrated during filling or while moving between the intermittent positions in the filling stations of the closed loop of chains 24 for certain products to assure product settling in bags 12 before sealing.

One or more intermittent positions along the horizontal portions of the parallelogram shape of the closed loop can include the bag opening device having suction cups 104 and 106 depending upon the types of materials which bags 12 are formed and the product and number of fill locations necessary for that product. For example, the product itself may be sufficient to hold end 22 open after product is filled in bags 12 in the first or later fill positions such that later fill positions do not need or do not require devices for opening bags 12. To insure that bags 12 are being held open by the bag opening device, vacuum checks can be made on suction cups 104 and/or 106 to insure that securement to bags 12 has occurred. Fill positions which do not have bag opening devices can utilize a photo eye check or the like to insure that bags 12 are open before filling occurs.

In the case of microwave popcorn popping bags 12, popcorn kernels, grease or oil, or the like can be dispensed by a suitable dispenser 132 in a stream in front of bottom 16 and preferably intermediate the bottom gusset of sides 18 and bottom 16.

After the filling operation, the vacuum to suction cups 104 and 106 is shut off to release bags 12 held in fixtures 32. Pivot arms 110 can then be pivoted to move angle iron 108 and suction cups 104 away from tops 14 and angle iron 108 is raised to its transport position. Simultaneously, rods 114 are moved horizontally to their transport positions in the lanes between fixtures 32 of carrier bars 30. At that time, roller chains 24 can be moved to advance carrier bars 30 and bag holding fixtures 32 in the operation direction to the next intermittent position. It can then be appreciated that tops 14 and the top gussets of sides 18 are able to deform or deflect around pins 280 with movement of fixtures 32 from the filling position after release of vacuum to suction cups 104.

When bags 12 are utilized for holding microwave popcorn, it can be appreciated that bags 12 can be loaded into fixtures 32 in a folded condition such as into ⅓–⅔ portions in the most preferred form, with the fold line between the portions of bags 12 abutting with bottom plates 40 inside of slot 46 of fixture 32. After filling and sealing, bags 12 can then be further folded into their commercialized form.

It should be appreciated that various overload protection devices can be utilized to stop operation of apparatus 10 or a particular station thereof in the event of a jam or other interruption in the opening and/or filling operation.

Now that the basic construction and operation of apparatus 10 according to the preferred teachings of the present invention have been explained, many extentions and variations may be obvious to a person skilled in the art. For example, although fixtures 32 have been shown and described as being formed of nonmovable parts, fixtures 32 can be of a hinged type which include legs which are openable and closeable. For example, the legs could be biased by springs to a normally closed position and can be cammed open against the bias of the springs. Vacuum suction cups could be provided to the legs of the fixtures to attach to the bag surfaces for opening with bags when the legs are hinged open, with the suction cups being continuously under vacuum or intermittently under vacuum only in the task positions where opening of the bag is desired. The legs of fixtures 32 can be shaped to correspond to the filled shape of bags 12.

Likewise, fixtures 32 could include a spring or like clamping member which sandwiches bags 12 in fixtures 32 to prevent bags 12 from slipping out of fixtures 32 during movement of fixtures 32 about the closed loops of roller chains 24. Suitable apparatus such as suction cups may be necessary to pull back such spring or clamping member during filling or removal operations.

Although bags 12 have been described in the most preferred form as microwave popcorn popping bags 12, bags 12 could be filled with other types of product than popcorn kernels such as but not limited to baking ingredients such as cake mixes, sauces such as catsup, and the like.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Device for opening a bag having a top panel, a bottom panel, an unsealed end, and first and second gusseted sides, with each gusseted side including at least a top gusset and a bottom gusset, with the top gusset being pivotally connected to the top panel about a fold line and the bottom gusset being pivotally connected to the bottom panel about a fold line, with the bag being movable in a lane in an operation direction generally perpendicular to the top panel and the bottom panel, comprising, in combination: first means for removable securement to the top panel; second means for removable securement to the bottom panel; means for moving the first means between a transport position and an attachment position; means for moving the second means from a transport position to an attachment position and then to an open position and back to the transport position, with the bag being movable in the operation direction past the first and second means in their transport positions and with the unsealed end of the bag being opened while the first means is in its attachment position and when the second means is moved from its attachment position to its open position; and means for biasing the separation of the bottom panel from the bottom gussets greater than the top panel from the top gussets comprising, in combination: first and second parallel pins positioned generally parallel to and spaced from each other a distance less than the distance between the fold lines of the top gussets and the top panel, means for moving said bags in said operation direction to a position in which the bag with both the bottom and top panels are on one side of the parallel pins and with the pins engaging the bottom panel of the bag below the unsealed end when the bag moves in the lane, said first and second pins engaging the top gussets and sandwiching them against the top panel while the first means is in its attachment position; wherein the bottom panel deforms around and is positioned on the Opposite side of the pins as the second means moves from the attachment position to the open position.

2. The bag opening device of claim 1 wherein the first and second pins have free ends, with the free ends engaging the bag below the unsealed ends.

3. The bag opening device of claim 2 wherein the bottom panel has a width less than the top panel, with the distance between the fold lines of the bottom panel and the bottom gussets being less than the distance between the fold lines of the top panel and the top gussets.

4. The bag opening device of claim 2 wherein the first and second pins are stationary, with the top panel deforming around the pins when the first means are not secured to the top panel and when the bag moves in the operation direction past the first and second pins.

5. The bag opening device of claim 1, wherein the bag has a side edge; and wherein the means for moving the second means comprises, in combination: a rod extending in a direction generally parallel to the bottom panel of the bag; means for moving the rod from the transport position located spaced from the bottom panel in a direction perpendicular to the operation direction and outwardly of the side edge of the bag to the attachment position located inwardly of the side edge of the bag and in the operation direction in front of the bottom panel of the bag, with the second means being attached to the rod.

6. The bag opening device of claim 5 wherein the means for moving the second means further comprises, in combination: means for tilting the rod in a plane extending parallel to the operation direction.

7. The bag opening device of claim 6 wherein the rod moving means comprises a slide shaft slideably movable between the attachment position and the transport position and in a direction perpendicular to the operation direction, with the rod mounted to the slide shaft.

8. The bag opening device of claim 7 wherein the rod tilting means comprises means for moving the slide shaft along an arc.

9. The bag opening device of claim 5 wherein the rod moving means comprises a slide shaft slideably movable between the attachment position and the transport position and in a direction perpendicular to the operation direction, with the rod mounted to the slide shaft.

10. The bag opening device of claim 1 wherein the means for moving the first means comprises, in combination: an elongated bar having an elongated length extending in a direction perpendicular to the operation direction and parallel to the top panel, with the elongated length being greater than the width of the top and bottom panels, with the first means mounted to the bar; and means located in a direction perpendicular to the operation direction and outwardly of the bag for moving the elongated bar in a direction perpendicular to the operation direction and the elongated bar between the transport position and the attachment position, with the elongated bar and the first means being spaced from the bag in the transport position, with the elongated bar and the first means being below the unsealed end in the attachment position.

11. The bag opening device of claim 1 wherein the means for moving the first means comprises, in combination: an elongated bar extending in a direction perpendicular to the operation direction and parallel to the top panel, with the first means mounted to the bar; and means for moving the elongated bar in a direction perpendicular to the operation direction and the elongated bar between the transport position and the attachment position, with the elongated bar and the first means being spaced from the bag in the transport position; and wherein the elongated bar moving means comprises, in combination: at least one post, with the elongated bar being slideably mounted to the post; means for sliding the elongated bar upon the post; a pivot arm pivotable about an axis perpendicular to the operation direction, with the post upstanding from the pivot arm; and means for pivoting the pivot arm about the axis.

12. In a device for opening a bag having a top panel, a bottom panel, first and second gusseted sides, and an unsealed end, with each gusseted side including at least a top gusset and a bottom gusset, with the top gusset being pivotally connected to the top panel about a fold line and the bottom gusset being pivotally connected to the bottom panel about a fold line; with the device including means for removable securement to the bottom panel and movable from an attachment position to an open position, an arrangement for biasing the separation of the bottom panel from the bottom gussets greater than the top panel from the top gussets comprising, in combination: first and second parallel pins positioned generally parallel to and spaced from each other a distance less than the distance between the fold lines of the top gussets and the top panel, means for moving said bags in said operation direction to a position in which the bag with both the bottom and top panels are on one side of the parallel pins and with the pins engaging the bottom panel of the bag below the unsealed end, with the bottom panel deforming around and positioned on the opposite side of the pins as the removable securement means moves from the attachment position to the open position with the first and second pins engaging the top gussets and sandwiching them against the top panel.

13. The bag opening device of claim 12 wherein the first and second pins have free ends, with the free ends engaging the bag below the unsealed ends.

14. The bag opening device of claim 12 wherein the bottom panel has a width less than the top panel, with the distance between the fold lines of the bottom panel and the bottom gussets being less than the distance between the fold lines of the top panel and the top gussets.

15. The bag opening device of claim 14 wherein the pins are within the fold lines of the bottom gussets and the bottom panel.

16. The bag opening device of claim 12 wherein the bag is movable in a lane in an operation direction generally perpendicular to the top panel and the bottom panel; and wherein the first and second pins are stationary, with the bottom panel abutting with the first and second pins in the attachment position and with the top panel deforming around the pins when the bag moves in the operation direction past the first and second pins.

17. Device for opening a bag having a top panel, a bottom panel, a side edge and an unsealed end, with the bag being movable in a lane in an operation direction generally perpendicular to the top panel and the bottom panel, comprising, in combination: means for removable securement to the bottom panel; a rod extending in a direction generally parallel to the bottom panel of the bag, with the removable securement means being attached to the rod; means for moving the rod and the removable securement means attached thereto from a transport position to an attachment position and then to an open position and back to the transport position, with the bag being movable in the operation direction past the removable securement means in the transport position and with the unsealed end of the bag being opened when the removable securement means is moved from its attachment position to its open position, with the rod in the transport position located spaced from the bottom panel in a direction perpendicular to the operation direction and outwardly of the side edge of the bag, with the rod in the attachment position located inwardly of the side edge of the bag and in the operation direction in front of the bottom panel of the bag.

18. The bag opening device of claim 17 wherein the moving means comprises, in combination: means for tilting the rod in a plane extending parallel to the operation direction from the attachment position to the open position.

19. The bag opening device of claim 18 wherein the moving means comprises a slide shaft slideably movable between the attachment position and the transport position and in a direction perpendicular to the operation direction, with the rod mounted to the slide shaft.

20. The bag opening device of claim 19 wherein the rod tilting means comprises means for moving the slide shaft along an arc.

21. The bag opening device of claim 17 wherein the moving means comprises a slide shaft slideably movable between the attachment position and the transport position and in a direction perpendicular to the operation direction, with the rod mounted to the slide shaft.

22. Device for opening a bag having a top panel, a bottom panel and an upper unsealed end, with the bag being movable in a lane in an operation direction generally perpendicular to the top panel and the bottom panel, comprising, in combination: means for moving said bags in said operation direction, means for removable securement to the top panel; an elongated bar having an elongated length between opposite ends and extending horizontally in a direction perpendicular to the operation direction and parallel to the top panel, with the elongated length being greater than the width of the top and bottom panels, with the removable securement means mounted to the elongated bar intermediate the opposite ends; and means located at the opposite ends of the elongated bar and on opposite sides and outwardly of the bag for moving the elongated bar in a direction perpendicular to the operation direction and the elongated bar between a transport position and an attachment position, with the elongated bar and the removable securement means being spaced from the bag in the transport position and being below the unsealed end in the attachment position.

23. Device for opening a bag having a top panel, a bottom panel and an unsealed end, with the bag being movable in a lane in an operation direction generally perpendicular to the top panel and the bottom panel, comprising, in combination: means for removable securement to the top panel; an elongated bar extending in a direction perpendicular to the operation direction and parallel to the top panel, with the removable securement means mounted to the elongated bar; and means for moving the elongated bar in a direction perpendicular to the operation direction and the elongated bar between a transport position and an attachment position comprising, in combination: at least one post, with the elongated bar being slideably mounted to the post for slideable movement along the post; and means for sliding the elongated bar upon the post, with the elongated bar and the removable securement means being spaced from the bag in the transport position.

24. The bag opening device of claim 23 wherein the tilting means comprises, in combination: a pivot arm pivotable about an axis perpendicular to the operation direction, with the post upstanding from the pivot arm; and means for pivoting the pivot arm about the axis.

25. Method for opening a bag having a top panel, a bottom panel, first and second gusseted sides, and an unsealed end, with each gusseted side including at least a top gusset and a bottom gusset, with the top gusset being pivotally connected to the top panel about a fold line and the bottom gusset being pivotally connected to the bottom panel about a fold line, comprising the steps of: moving the bag in an operation direction generally perpendicular to the top panel and the bottom panel of the bag to an intermittent position; engaging the bottom panel of the bag at said intermittent position below the unsealed end at first and second, spaced, parallel locations generally parallel to and at a distance less than the distance between the fold lines of the top gussets and the top panel, with both the bottom and top panels of the bag located on one side of the first and second engagement locations; moving the bottom panel of the bag relative to the top panel to an open position, with the bottom panel deforming around and positioned on the opposite side of the engagement locations as the bottom panel moves to the open position with the first and second engagement locations then engaging the top gussets and sandwiching them against the top panel to bias the separation of the bottom panel from the bottom gussets greater than the separation of the top panel from the top gussets.

26. The method of claim 25 wherein the bottom panel has a width less than the top panel, with the distance between the fold lines of the bottom panel and the bottom gussets being less than the distance between the fold lines of the top panel and the top gussets; and wherein the first and second engagement locations are within the fold lines of the bottom gussets and the bottom panel.

27. The method of claim 25 further comprising the steps of: filling the bag with product while the bottom panel is in the open position; and moving the bag in the operation direction after filling with the top panel deforming around the first and second engagement locations when the bag moves in the operation direction past the first and second engagement locations.

28. Method for opening a bag having a top panel, a bottom panel, a side edge and an unsealed end comprising the steps of: moving the bag in a lane in an operation direction generally perpendicular to the top panel and the bottom panel to an intermittent position; providing means for removable securement to the bottom panel; positioning the removable securement means in a transport position located spaced from the bottom panel in a direction perpendicular to the operation direction and outwardly of the side edge of the bag while the bag moves in the operation direction; and positioning the removable securement means in an attachment position located inwardly of the side edge of the bag and in the operation direction of the bottom panel of the bag when the bag is in the intermittent position.

29. The method of claim 28 further comprising the steps of: tilting the removable securement means in a plane extending parallel to the operation direction to an open position after the removable securement means is in the attachment position and when the bag is in the intermittent position.

30. The method of claim 29 further comprising the steps of: providing means for removable securement to the top panel; positioning the top panel removable securement means in a transport position spaced from the bag while the bag moves in the operation direction; and moving the top panel removable securement means when the bag is in the intermittent position in a direction from the transport position to an attachment position perpendicular to the operation direction and to the movement direction of the bottom panel removable securement means from the transport position to the attachment position with the top panel removable securement means in the attachment position located in the operation direction of the top panel of the bag.

31. Device for opening a bag having a top panel, a bottom panel, first and second gusseted sides, a side edge and an unsealed end, with each gusseted side including at least a top gusset and a bottom gusset, with the top gusset being pivotally connected to the top panel about a fold line and the bottom gusset being pivotally connected to the bottom panel about a fold line, with the bag being movable in a lane in an operation direction generally perpendicular to the top panel and the bottom panel, comprising, in combination: first means for removable securement to the top panel; second means for removable securement to the bottom panel; means for moving the first means between a transport position and an attachment position; means for moving the second means from a transport position to an attachment position and then to an open position and back to the transport position, with the bag being movable in the operation direction past the first and second means in their transport positions and with the unsealed end of the bag being opened while the first means is in its attachment position and when the second means is moved from its attachment position to its open position; and means for biasing the separation of the bottom panel from the bottom gussets greater than the top panel from the top gussets; wherein the means for moving the second means comprises, in combination: a rod extending in a direction generally parallel to the bottom panel of the bag; means for moving the rod from the transport position located spaced from the bottom panel in a direction perpendicular to the operation direction and outwardly of the side edge of the bag to the attachment position located inwardly of the side edge of the bag and in the operation direction in front of the bottom panel of the bag, with the second means being attached to the rod; and wherein the means for moving the first means comprises, in combination: an elongated bar extending in a direction perpendicular to the operation direction and parallel to the top panel, with the first means mounted to the bar; and means for moving the elongated bar in a direction perpendicular to the operation direction and the elongated bar between the transport position and the attachment position, with the elongated bar and the first means being spaced from the bag in the transport position.

32. The bag opening device of claim 22 wherein the elongated bar moving means comprises, in combination: at least one post, with the elongated bar being slideably mounted to the post; means for sliding the elongated bar upon the post; a pivot arm pivotable about an axis perpendicular to the operation direction, with the post upstanding from the pivot arm; and means for pivoting the pivot arm about the axis.

* * * * *

UNITED STATES PATENT AND TRADEMARK OFFICE

CERTIFICATE OF CORRECTION

PATENT NO. : 5,507,132

DATED : April 16, 1996

INVENTOR(S) : Rodney K. Gwiazdon, John E. Korte, Richard S. Deadmond, Frank C. Starr It is certified that error appears in the above-identified patent and that said Letters Patent is hereby corrected as shown below:

Column 9, line 10; "Opposite" should be -- opposite --;

Column 12, line 2; after "position" insert -- , means for tilting the post for moving the removable securement means towards the top panel of the bag --.

Signed and Sealed this

Tenth Day of September, 1996

Bruce Lehman

*Attest:*

BRUCE LEHMAN

*Attesting Officer*

*Commissioner of Patents and Trademarks*